US005797783A

United States Patent [19]

Harris

[11] Patent Number: 5,797,783

[45] **Date of Patent: *Aug. 25, 1998**

[54] TOY BALLOON PACKAGING

[75] Inventor: Dale Alan Harris, Chicago, Ill.

[73] Assignee: M & D Balloons, Inc., Manteno, Ill.

[ * ] Notice: The term of this patent shall not extend beyond the expiration date of Pat. No. 5,514,022.

[21] Appl. No.: 674,856

[22] Filed: Jul. 3, 1996

Related U.S. Application Data

[63] Continuation of Ser. No. 370,678, Jan. 10, 1995, abandoned, which is a continuation-in-part of Ser. No. 333,600, Nov. 2, 1994, Pat. No. 5,514,022, which is a continuation of Ser. No. 41,755, Apr. 2, 1993, abandoned.

[51] Int. Cl.[6] ..... A63H 27/10; G09F 21/06

[52] U.S. Cl. ..... 446/77; 446/71; 446/220; 40/124.05; 40/214

[58] Field of Search ..... 446/73, 71, 75, 446/77, 220, 222, 223, 225; 40/124.05, 124.01, 212, 214

[56] References Cited

U.S. PATENT DOCUMENTS

| | | | |
|---|---|---|---|
| 1,300,640 | 4/1919 | Pasternak . | |
| 2,635,386 | 4/1953 | Guishard . | |
| 3,092,388 | 6/1963 | Wagenheim | 446/220 X |
| 4,077,588 | 3/1978 | Hurst . | |
| 4,305,501 | 12/1981 | Collette | 446/220 X |
| 4,307,537 | 12/1981 | Bergmann . | |
| 4,787,575 | 11/1988 | Stewart | 116/210 X |
| 4,813,902 | 3/1989 | Messer | 446/71 |
| 4,857,029 | 8/1989 | Dierick et al. . | |
| 4,917,646 | 4/1990 | Kieves . | |
| 4,932,915 | 6/1990 | Boris et al. . | |
| 4,936,460 | 6/1990 | Meyer . | |
| 5,004,633 | 4/1991 | Lovik | 446/221 X |
| 5,009,624 | 4/1991 | Estam-Goggin | 446/71 |
| 5,024,011 | 6/1991 | Collins | 446/220 X |
| 5,035,391 | 7/1991 | Steele et al. | 446/220 X |
| 5,074,510 | 12/1991 | Metz . | |
| 5,108,339 | 4/1992 | Kieves . | |
| 5,573,437 | 11/1996 | Van Dyke et al. | 446/220 X |

FOREIGN PATENT DOCUMENTS

| | | | |
|---|---|---|---|
| 854768 | 11/1952 | Germany | 446/220 |

OTHER PUBLICATIONS

"ONEPAC" M&D Balloons, Manteno, IL. Copy of promotional flyer, and front and back of package card.

Van Dyke et al, "Packaged Balloon and Greeting Card", Assignee: CTI Industries Corp., Published: Aug. 16, 1994, USPTO.

Classic "Balloon-In-A-Card," front and back of package.

"Get a Handle on your Balloons . . . ." *Balloons and Parties Today*, Advertisement—Reader Response #33, p. 50, No date shown.

"UNIQUE® Balloon Weights," *Balloons and Parties Today*, Advertisement—Reader Response #24, No date shown.

*Primary Examiner*—Robert A. Hafer
*Assistant Examiner*—Laura Fossum
*Attorney, Agent, or Firm*—Fitch, Even, Tabin & Flannery

[57] ABSTRACT

A balloon kit package is provided to facilitate erection of a balloon assembly in a desired manner so as to prevent unintentional loss of buoyant balloons. The kit package includes an uninflated balloon, a placard greeting card or other object of mass sufficient of mass to overcome the buoyancy of the balloon when inflated and articles such as a ribbon for joining the balloon to the placard. In an alternative embodiment, the neck of the balloon is inserted directly into the placard. In package form the balloon kit is sealed in a plastic overwrap.

13 Claims, 6 Drawing Sheets

Fig. 1
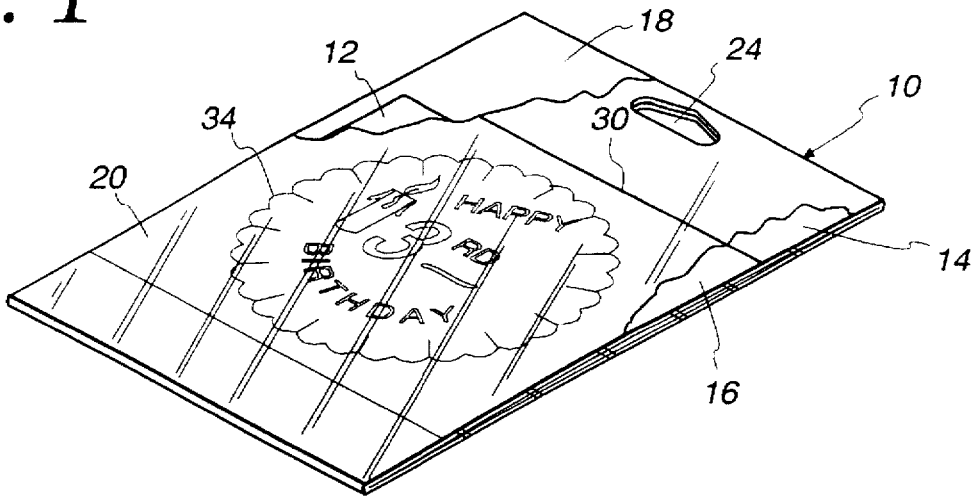
Fig. 4
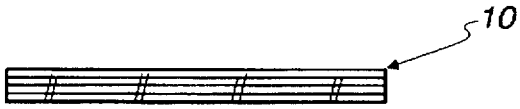
Fig. 2
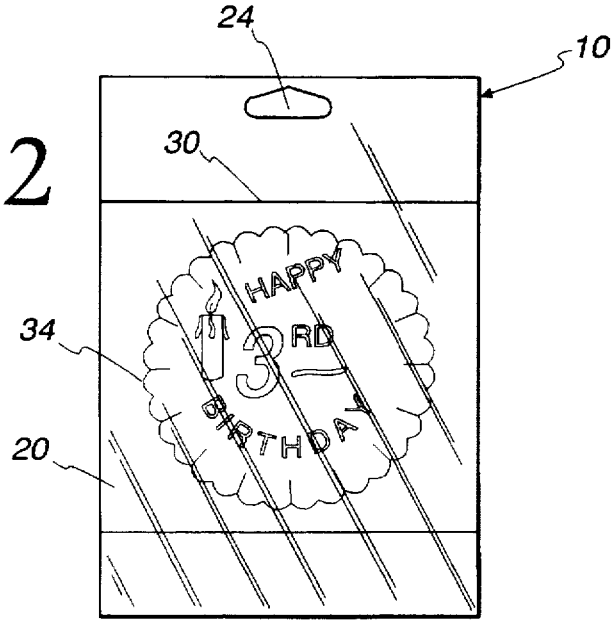
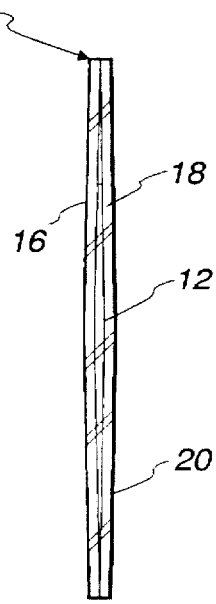
Fig. 3
Fig. 5
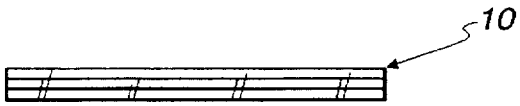

TOY BALLOON PACKAGING

CROSS-REFERENCE TO RELATED APPLICATIONS

This application is a continuation application of U.S. Patent application Ser. No. 08/370,678, filed Jan. 10, 1995, now abandoned, which is a continuation-in-part application of U.S. Patent application Ser. No. 08/333,600, filed Nov. 2, 1994 and issued on May 7, 1996 as U.S. Pat. No. 5,514,022, which is a continuation application of U.S. Patent application Ser. No. 08/041,755, filed Apr. 2, 1993, now abandoned.

BACKGROUND OF THE INVENTION

1. Field of the Invention

The present invention pertains to packaging for toy balloons.

2. Description of the Related Art

Substantial numbers of toy balloons are purchased at public events, novelty shops, stores selling greeting cards and similar items and similar commercial enterprises. Typically, the toy balloons are one of a wide variety of products offered for sale in these establishments, and accordingly, there may be little or no opportunity for store personnel to become acquainted with the stockkeeping units and other identifying indicia provided by balloon manufacturers for the trade. There is an ever-increasing variety of toy balloon products. For example, toy balloons are typically imprinted with widely varying artwork, lettering, and on occasion, special legends. Further, toy balloons bearing the same artwork and lettering are offered in a number of different sizes.

Merchandise inventory and stockkeeping systems employed today typically use text or verbal description to identify the commercial product. While these systems have been immediately accepted for many different products, significant difficulties have been encountered in the field of toy balloon merchandising, where different artwork (e.g., fanciful illustrations of animals) may deal with a common theme for which verbal descriptions are at best confusing, and at worst are identical or otherwise nondistinguishing. For example, a verbal description such as "duck carrying Happy Birthday sign" may not be meaningful to store personnel who are only casually familiar with the toy balloons currently carried by the store. As a result, the toy balloons are usually taken out of stock and presented to a potential customer to identify the product in an effort to "close the sale." All but the smallest size balloons are shipped folded and are oftentimes inventoried in a store as a stack resembling a stack of folded sheets of film. For a customer who might want to examine several different balloon designs, the stack of folded balloons must be examined for duplicates, with balloons having the desired design, and the desired size being extracted from the pile. Very often, this is laborious and time-consuming and improvements have been sought.

Toy balloons made of a metalized film are becoming increasingly popular. These types of balloons are often filled with a gas which is "lighter than air", with the result that the balloons, when released, tend to ascend at a rate such that the balloon quickly passes beyond a person's grasp. In an effort to accommodate users who may not be familiar with this phenomenon, sellers of toy balloons may tie a string or ribbon to the balloon as a convenient tether. Despite these precautions, a momentary lapse of attention can result in loss of the toy balloon. Accordingly, weights have been manufactured and distributed separately from the toy balloons, but intended for eventual use therewith. These weights are typically comprised of either plastic or of one or more layers of paperboard material shaped in the form of a rectangular tab of sufficient mass so as to counterbalance the buoyancy of the balloon. When employed, these weights are typically connected to the balloon by store personnel using a separate ribbon or string or other restraint line.

SUMMARY OF THE INVENTION

It is an object according to principles of the present invention, to provide improved systems for neutralizing the buoyancy of lighter-than-air metalized balloons.

Another object according to principles of the present invention is to provide improved packaging for toy balloons which allows a seller to quickly identify the artwork imprinted on the balloon.

A further object according to principles of the present invention is to provide an integrated system which promotes the assembly of a buoyant balloon with appropriate weighting means to at least partly overcome the buoyancy of the balloon, prior to delivery of the balloon to a consumer. A related object according to principles of the present invention is to provide a prepackaged kit containing all of the necessary elements for producing a buoyant balloon with neutralized buoyancy, which are so arranged and optionally fully or partly preassembled to enhance the ease of assembly by store personnel.

These and other objects according to principles of the present invention are provided in a kit package for a toy balloon, the kit package comprising:

a noninflated toy balloon adapted to be inflated with a lighter than air gas to a preselected buoyancy upon removal from the kit package;

a tab which forms at least part of the kit package, the tab having a predetermined weight sufficient to balance the buoyancy of the balloon when the balloon is inflated with the lighter than air gas to the preselected buoyancy, the tab having an aperture; and an elongated flexible restraint line contained in the package for attaching the inflated toy balloon to the tab, the lower end of the line passing through the aperture in the tab, the upper end of the line attached to the inflated balloon.

BRIEF DESCRIPTION OF THE DRAWINGS

FIG. 1 is a perspective view of a balloon package according to principles of the present invention;

FIG. 2 is a front elevational view thereof;

FIG. 3 is an elevational view from the right side thereof, the elevational view from the left side thereof being a mirror image;

FIG. 4 is top plan view thereof;

FIG. 5 is a bottom plan view thereof;

DETAILED DESCRIPTION OF THE PREFERRED EMBODIMENT

Figure 6:
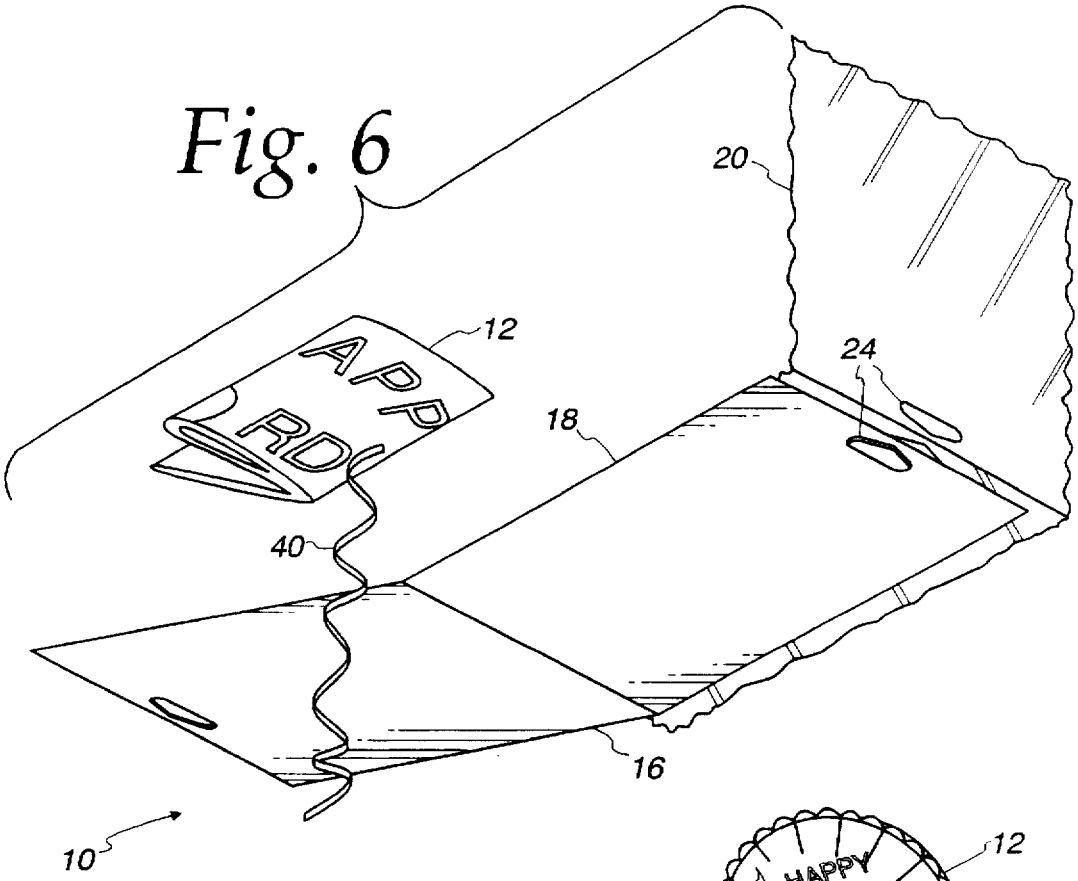
FIG. 6 is an exploded perspective view thereof.

Referring now to the drawings, and in particular to FIG. 1, a package for a toy balloon is generally indicated at 10. The package includes a toy balloon 12 in a noninflated, folded condition, disposed within a paperboard placard 14, preferably of monolithic construction, folded at the bottom end to form overlapping layers 16, 18. Surrounding the placard is a plastic overwrap 20, preferably of transparent plastic film.

In the preferred embodiment, a generally triangular aperture 24 extends through the plastic overwrap 20 and placard 14 for receiving the hook of a display device. In the preferred embodiment, the placard 14 is generally coextensive with the major surfaces of package 10. The placard 14 provides strength for the package, to allow the package to hang, resisting localized tearing forces adjacent the aperture 24. If desired, the placard 14 could be shortened, so as to provide localized support adjacent the aperture 24. For example, the placard 14 could be truncated along the linear design element or line 30 with the bottom portion of the placard, below design line 30, being omitted. This would provide localized strength or reinforcement adjacent the aperture 24 and would provide the package strength necessary to hang package 10 from a display hook.

However, placard 14 is preferably of a substantially larger size so as to include photographic or other artwork indicia 34 showing the balloon in its inflated condition, or at least showing the artwork on a major face of the balloon. As mentioned, the placard 14 has two overlapping layers 16, 18. The indicia 34 is printed on the upper lay 16 and faces in a forward direction. If artwork is applied to both external major surfaces of the balloon, similar indicia could be provided on layer 18 of placard 14, facing in an opposed, downward direction, the package thus providing an indication of the artwork on both opposing major surfaces of the balloon. In the preferred embodiment, the balloon 12, when unfolded, has major surfaces several times the area of the major surface of package 10. Thus, even if the outer fold of the balloon were observed, a pattern of the balloon still might not be recognizable from the small sampled area. With photographic, line drawing or other artwork techniques, the representation 34 of the inflated balloon can quickly provide identification of the balloon artwork for store personnel, even for complex artwork subject matter.

In addition to providing a literal indication of the balloon artwork, the placard 14 can provide a category reference of the kind usually associated with greeting cards (e.g., "anniversary", "birthday" and "congratulations"). Bar code labeling can also be applied to the placard 14, along with other stockkeeping information.

Further significant advantages are possible with the present invention. For example, the balloon package can now be displayed along with other products, accessible to potential purchasers for their personal inspection as an aid in making a purchasing decision.

Thus, the balloon package can "sell itself", without requiring a shopkeeper's attention, which can be devoted for other tasks.

Additional advantages are also possible with the present invention. For example, verbal or graphic instructions for assembling the contents of the package can be prominently displayed on the reverse side of the placard 14. Alternatively, the placard can take the form of a greeting card, as will be seen below. For balloons which are to be filled with a gas lighter than air, the consumer and store personnel can be educated as to the proper assembly of the package contents in order to prevent loss of the buoyant balloon. With the present invention, instructions can be given to the salesperson inflating the balloon so that the balloon is immediately adapted for secure retention at the time of its inflation. Further, apart from the instructions which may be placed on placard, a salesperson is prompted to complete the assembly by reason of the presentation of the component parts when the overwrap is opened. For example, referring to FIG. 6, the balloon package 10 further includes a restraint line or ribbon 40 to be tied between the balloon and the placard 14. The placard 14 can include instructions for the completed balloon assembly shown in FIG. 7 and can even contain a photograph or drawing showing the completed balloon assembly.

Figure 7:
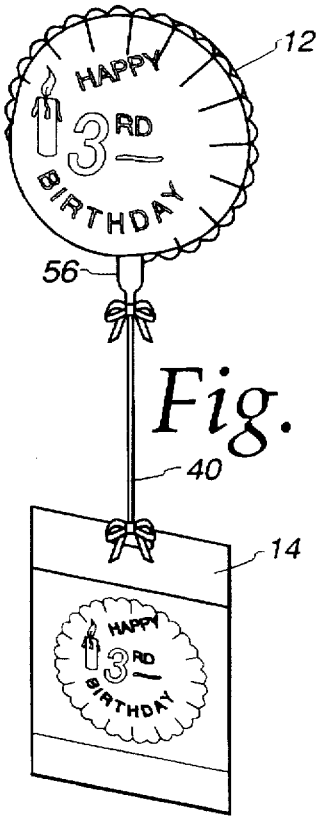
FIG. 7 is a perspective view of a completed balloon assembly.

Referring to FIG. 7, the ribbon 40 is tied at its opposed ends to balloon 12 and placard 14. If desired, the connection of ribbon 40 to the placard 14 can be done prior to packaging in the overwrap 20 and can, for example, be incorporated into an overall design and printed on placard 14.

Figure 9:
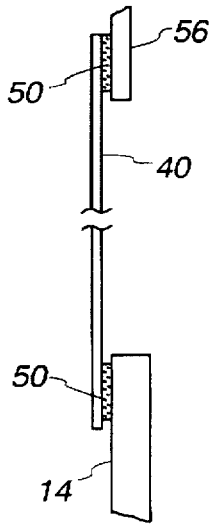
FIGS. 8 and 9 show alternative arrangements for joining the components of the package together.
Figure 8:
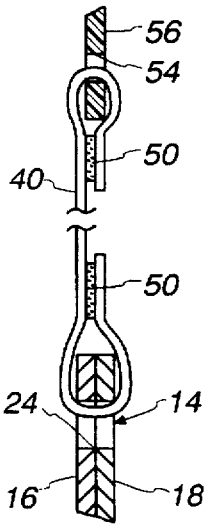

Referring now to FIGS. 8 and 9, the ribbon 40 can be provided with an adhesive coating 50. As shown in FIG. 8, the upper end of ribbon 40 is looped through an aperture 54 formed in the neck 56 of balloon 12. The upper end of ribbon 40 is doubled over, with the adhesive coating 50 securing the free end of the ribbon to a mid-portion of the ribbon to form a closed loop. The bottom end of ribbon 40 is, in a similar manner, threaded through aperture 24 in placard 14, being doubled over and secured to a mid-portion of ribbon 40 by a second adhesive coating 50. As shown in the alternative embodiment of FIG. 9, the upper end of ribbon 40 is secured to neck 56 with the adhesive portion 50. If desired, the adhesive joinder can be replaced with a heat-sealed joinder, with ribbon 40 or coating 50 made from a heat-sealable material. The bottom end of ribbon 40 is secured to a surface of placard 14 with a second adhesive portion 50. If desired, the bottom portion of ribbon 40 can also be secured to placard 14 with heat sealing or other joining methods. It is generally preferred, however, that the adhesive coating 50 be applied to the free ends of ribbon 40 at the time of ribbon manufacture, and be temporarily covered in a conventional fashion, with a sheet of release material which can be peeled away to expose the adhesive portions.

Figure 10:
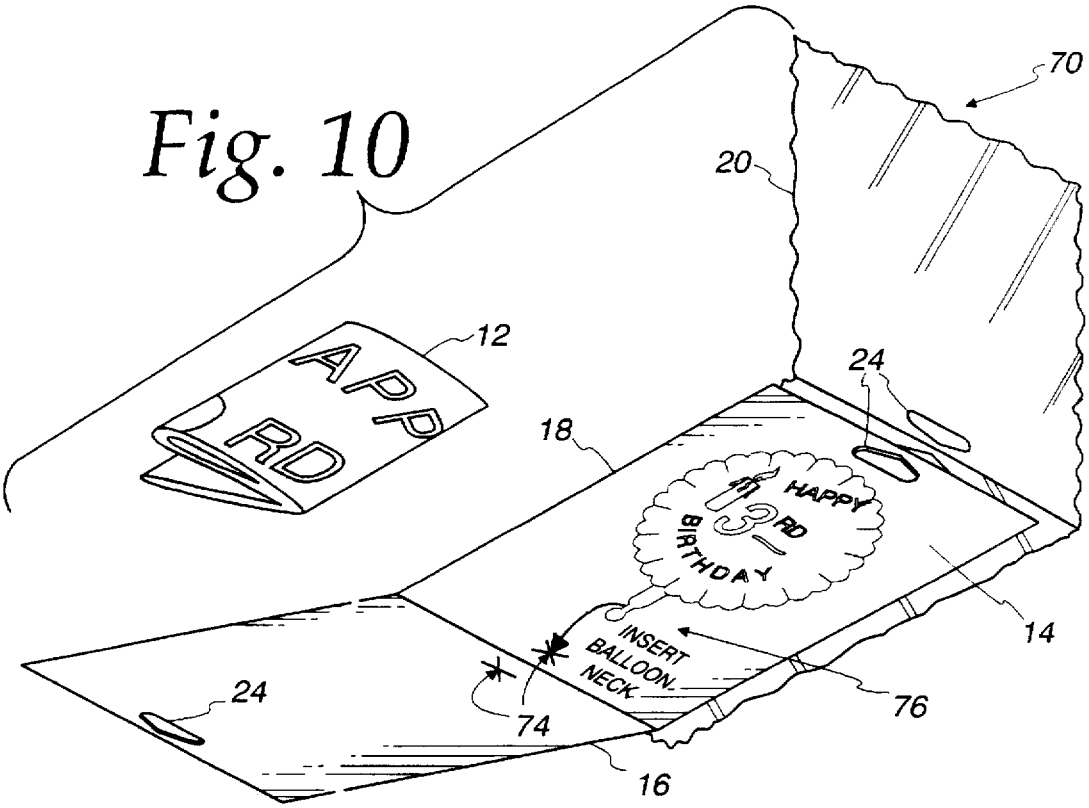
FIG. 10 is a perspective view of an alternative balloon package.
Figure 13:
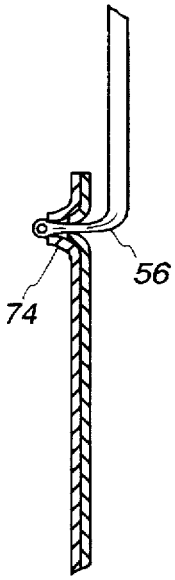
FIG. 13 is a fragmentary cross-sectional view of FIG. 12.
Figure 12:
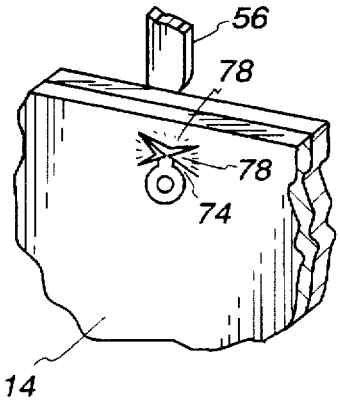
FIG. 12 is a fragmentary perspective view showing the portion of FIG. 11 on an enlarged scale.
Figure 11:
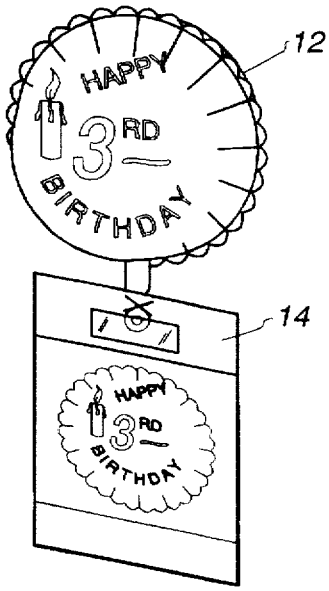
FIG. 11 is a perspective view of a completed balloon assembly constructed from the package.

Referring now to FIG. 10, an alternative embodiment of a balloon package is generally indicated at 70. The balloon package includes balloon 12, placard 14 and an overwrap 20. The placard 14 is preferably made of paper material, such as paperboard or cardboard, as in the preceding embodiment, and the overwrap 20 is preferably made of transparent plastic material. In this embodiment, a ribbon is not provided; rather, the balloon neck is inserted directly through the placard 14. In the embodiment shown in FIGS. 10–12, the placard 14 has the same configuration as described above, with overlapping layers 16, 18 in apertures 24 for receiving a display hook. However, in the embodiment shown in FIG. 10, additional features are added, including X-shaped slits 74 and further assembly instructions 76 printed on the inside or hidden surfaces of the placard. Referring to FIGS. 12 and 13, the balloon neck is inserted through the X-shaped slits 74 creating a plurality of retention barbs 78 which engage the balloon neck, preventing its retraction from placard 14, thus ensuring a secure engagement with the balloon.

Various alternative constructions are contemplated by the present invention. For example, the placard 14 may be constructed of materials other than paper products. For example, the placard 14 may be made of plastics materials and, in keeping with the balloon message, may comprise plastic molded articles of appropriate shape. For example, the legend on the illustrated balloon 12 may be complemented with a plastic numeral "3" of sufficient weight to substantially alter the buoyancy of the balloon. The X-shaped slits may be provided in the plastic numeral or a ribbon may be provided, as illustrated above, to secure the plastic numeral to the balloon. The plastic article could also comprise a medallion bearing an appropriate message, which would add to the visual impact of the complete balloon assembly.

The placard 14 can be replaced with a weighting member that need not be rectangular or flat or stiff, although such is preferred.

Also, further variations relating to merchandising techniques are also possible. For example, the balloon 12 has been shown in an individual wrapping, with a transparent plastic overwrap. If desired, the contents contained within the overwraps described above can be shipped without the overwrap, in kit form, the kit contents usually being assembled by the personnel inflating the balloon included as part of the kit. For example, multiple balloon kits can be shipped to a store in an expanding plastic wallet, much like the plastic windows inserted in leather wallets in common use today. In this manner, balloon kits can be shipped to the store in bulk form. Of course, several balloon kits can be assembled in a common overwrap if desired.

With the present invention, packaged or unpackaged balloon kits can now be associated with other types of commercial articles. For example, balloon packages or balloon kits can be associated with stuffed animals, with the balloon kits or contents of the balloon packages being assembled at the time the stuffed animal is sold, to provide a finished commercial article comprising the combination of stuffed animal and balloon assembly. In any event, as can now be seen with the present invention, buoyant metalized and plastic balloons can now be secured to an attractive (and optionally, instructive) weight, to control the ascent of the balloon so as to position a free-floating balloon in space, or to effectively prevent its unintentional escape.

With placards having a generally planar surface, a purchaser of a balloon assembly can easily apply an adhesive label or sticker to the placard to complete the balloon product. For example, balloon kits or balloon packages can be purchased in quantity, for use in a particular social event. A user can bring adhesive labels to the site where the balloons are inflated, and can apply individual, customized, and perhaps proprietary labels to the balloon placards to further customize and enhance the presentation of the finished balloon to its intended recipient (such as employees or customers of the purchaser, for example).

Figure 14:
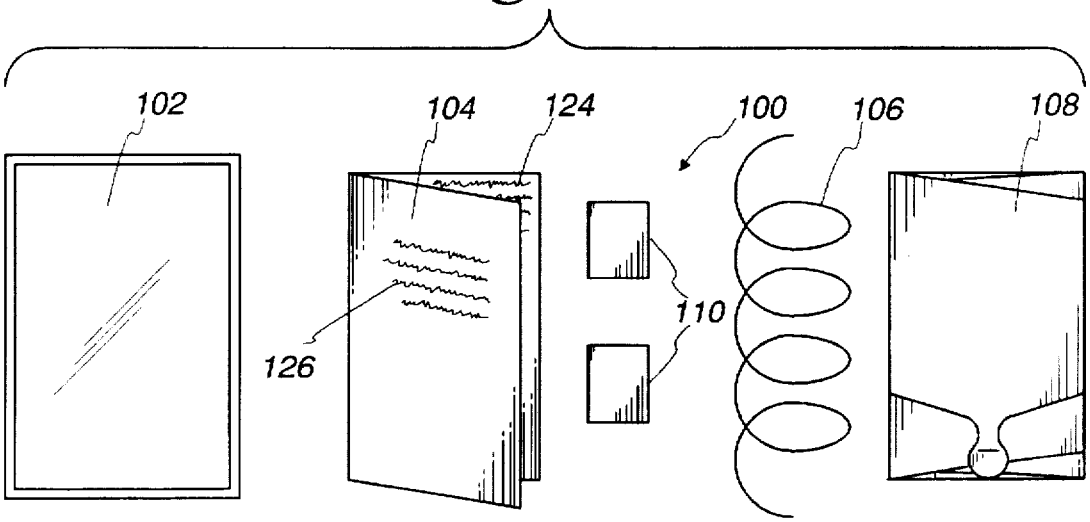
FIG. 14 is an exploded view of an alternative kit package according to principles of the present invention.
Figure 15:
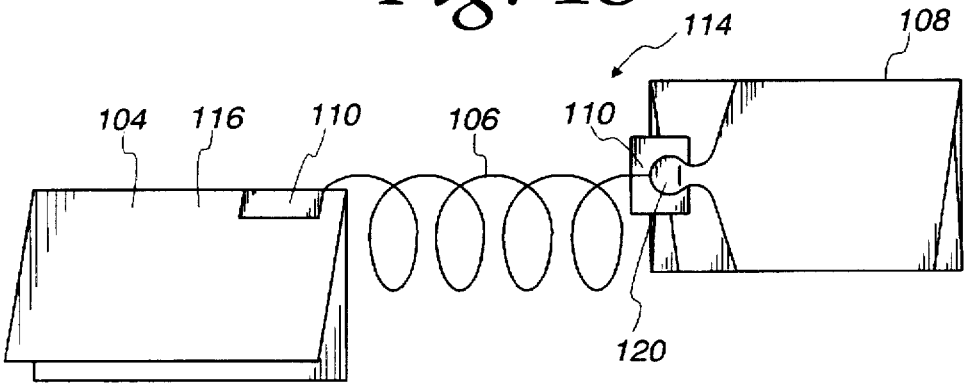
FIG. 15 shows the balloon and counterweight assembly thereof prior to inflation.
Figure 16:
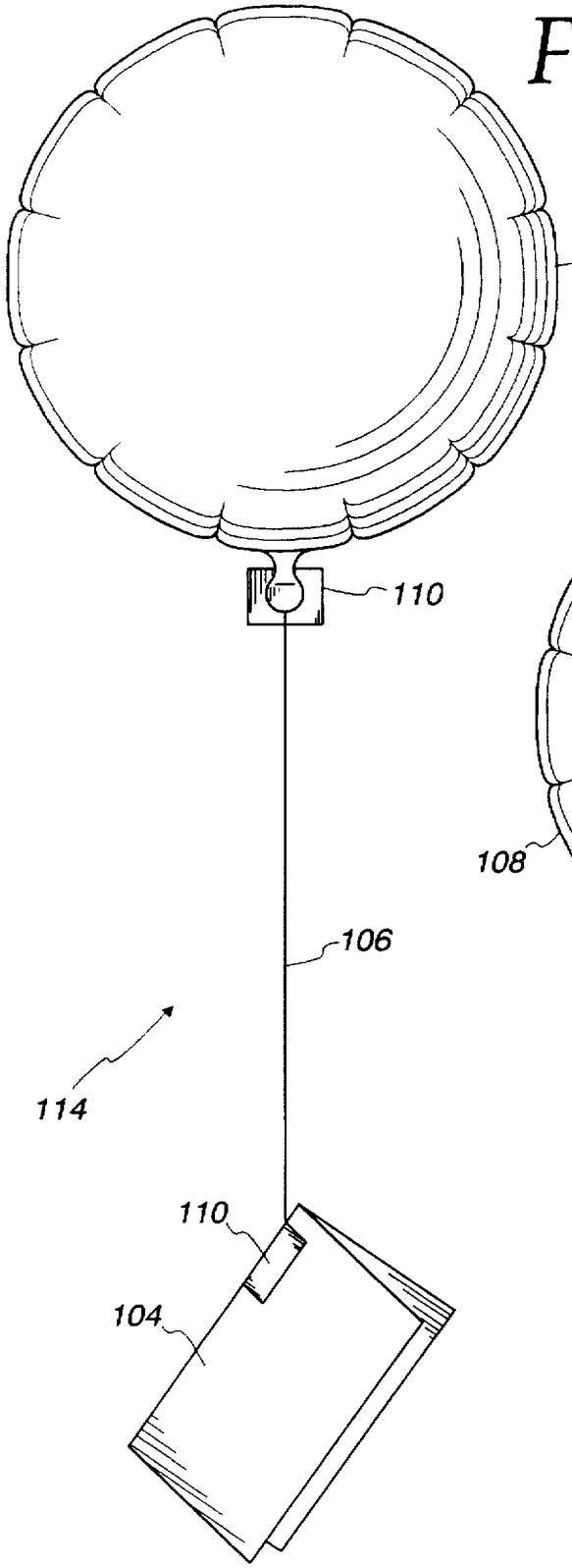
FIG. 16 shows the assembly of FIG. 15 in an inflated condition.

Turning now to FIGS. 14–16, a kit package generally designated at 100 is shown prior to assembly. The kit package 100 includes an outer wrapper 102 in the form of a plastic overwrap or bag, a placard in the form of a greeting card 104, a restraint line or ribbon 106, uninflated balloon, 108 and self-adhesive tape portions 110.

FIG. 15 shows a completed balloon assembly generally indicated at 114 in which a first end of ribbon 106 is secured to balloon 108 by a first tape portion 110. The second end of ribbon 106 is secured to greeting card 104 by a second tape portion 110. The second tape portion 110 is shown affixed to the spine or outside corner 116 of greeting card 104.

Alternatively, the second tape portion 110 could be affixed to one of the interior surfaces of the greeting card or could be affixed entirely to an exterior surface of the greeting card. The kit package 100 can be shipped to a point of sale in several different configurations. First, the components illustrated in FIG. 14 could be left unassembled and inserted into the overwrap 102 which is then sealed for shipment to a sales center.

Alternatively, one or more of the individual components illustrated in FIG. 14 could be preassembled by the balloon manufacturer. For example, referring to FIG. 15, the first end of ribbon 106 could be attached directly to the stem 120 of balloon 108 using heat sealing or other techniques, thus eliminating the need for the first tape portion 110.

If desired, the entire balloon assembly 114 shown in FIG. 15 could be preassembled at the point of manufacture and inserted in overwrap 102 for delivery to a sales point. The uninflated balloon 108 could be folded so as to present an optimum image to the sales personnel to aid in identifying the particular balloon contained in the kit package, the overwrap 102 preserving the preferred orientation of the folded balloon during transit and storage. Alternatively, the appearance of the inflated balloon could be depicted on the face of the greeting card, with the folded balloon tucked inside of the greeting card prior to insertion in overwrap 102. Thus, the greeting card 104 can be seen to complement the artwork on the balloon 108.

The greeting card 104 is of a type in general use, and includes a substrate folded in two, so as to form overlying layers hingedly connected together along an outside corner or spine, such as a spine 116. If desired, a separate hinge means could be provided to connect the overlying portions of the substrate. For example, a plastic tape could be used to join two separate substrate portions, forming a hinge line at the joinder of those portions. If desired, balloon film material could be incorporated into the greeting card to provide a dramatic presentation to the intended recipient of the message conveyed by the balloon assembly. The greeting card 104 preferably includes a message 124 on one of its inside surfaces, and may also contain an optional message 126 on the outside surface of the card. As a further alternative, the overwrap 102 can be made transparent, and the greeting card can be folded inside-out with an interior surface exposed, interior surface being visible to store personnel to aid in their selection of the proper product to meet a customer's wishes. Upon assembly of the balloon assembly, the greeting card would be folded to resume its customary orientation with exterior surfaces exposed.

FIG. 16 shows the balloon assembly 114 in a fully assembled and inflated condition, with greeting card 114 providing counterbalancing weight to neutralize the buoyancy of the inflated balloon. The weight of the greeting card 104 could be chosen so as to cause the balloon assembly 114 to descend when support is removed, or can be chosen such that the balloon remains suspended at a preferred height off the ground. Positioning can be controlled, for example, by trimming portions of the greeting card 104.

Figure 17:
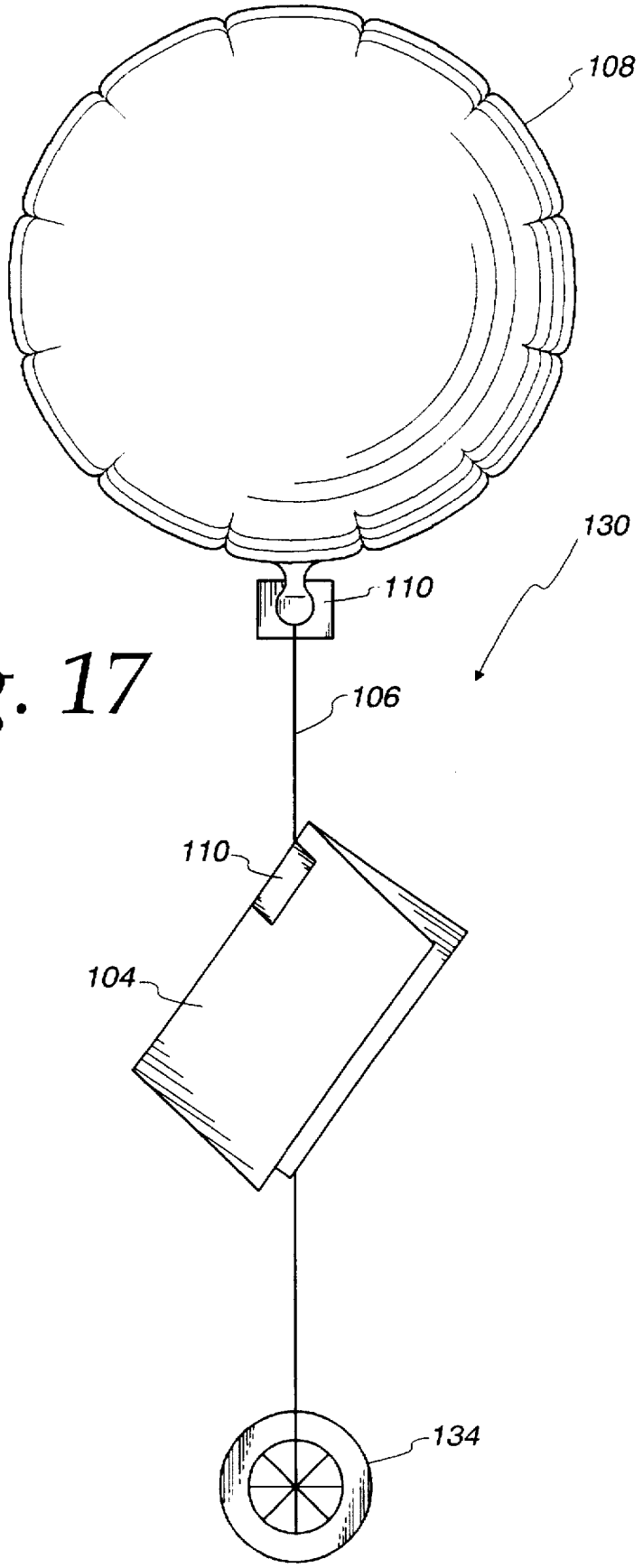
FIG. 17 shows an alternative balloon assembly.

FIG. 17 shows an alternative embodiment of the balloon assembly generally indicated at 130. In this embodiment, the greeting card 104 is affixed to a medial portion of ribbon 106, with supplemental weight being provided by a separate weight member 134. In the embodiment shown in FIG. 17, weight member 134 is formed of molded plastic and is made of a size and shape which is conveniently grasped by a recipient of the balloon assembly. As shown in FIG. 17, three items are simultaneously presented to a recipient: the inflated balloon 108, the greeting card 104 and the decorative weight 134. These can be configured to carry complementary messages or visual appearances. If desired, the three visual elements of balloon greeting card and weight could provide a sequence of message fragments which, when combined, provide a single unified message.

As a further alternative, a plurality of greeting cards 104 of reduced size can be provided along the length of ribbon 106. If the spines of the greeting cards are secured along the length of the ribbon, they will give the visual appearance of spinning when disturbed by air currents. The weight 134 could also be designed to either spin or to remain relatively fixed in position with respect to ribbon 106, and balloon 108 can bob up and down relatively slight amounts when exposed to air currents, thus presenting a large amount of visual activity to the recipient of the balloon assembly.

Figure 18:
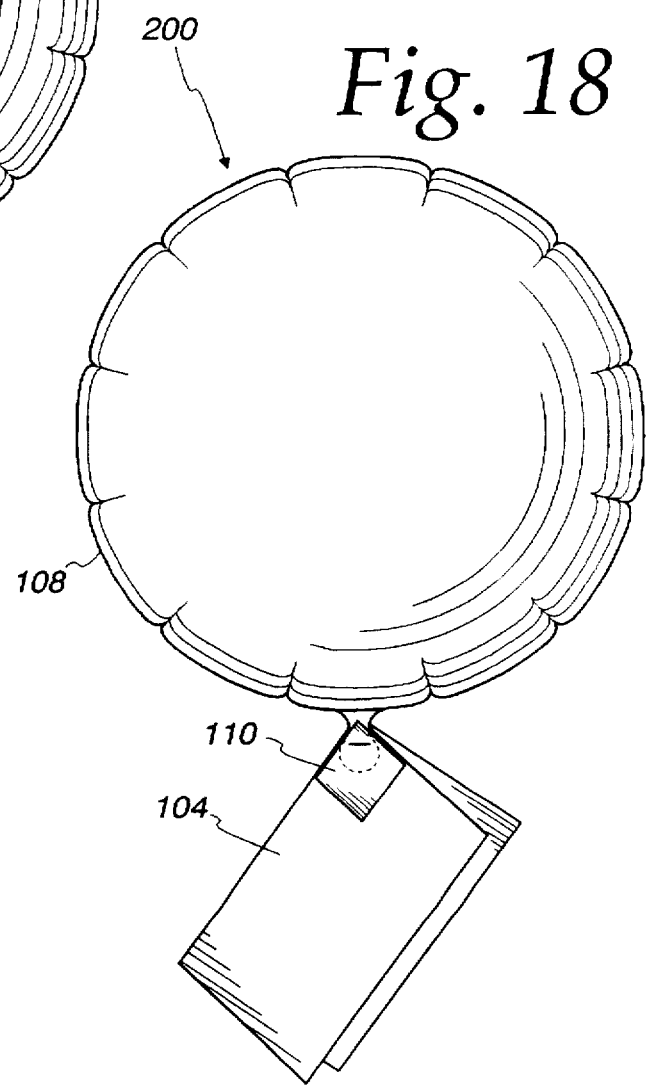
FIG. 18 shows a further alternative balloon assembly.

FIG. 18 shows a balloon assembly 200 with balloon 108 attached to greeting card 104 by tape portion 110 or other suitable fastener such as staples or adhesive.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A marketing display kit for a toy balloon, the kit comprising:

a package comprising a pocket;

a noninflated metallized balloon in the pocket;

the noninflated metallized balloon with a preselected volume to be inflated with a lighter-than-air gas upon removal from the package so as to assume a preselected buoyancy, the balloon having a surface with artwork which is displayed when the balloon is inflated;

an elongated flexible restraint line contained in the package for attaching the metallized balloon to at least part of the package, the lower end of the line for attachment to at least part of the package, the upper end of the line for attachment to the balloon when it is inflated; and at least part of the package having sufficient weight to balance the buoyancy of the balloon when the balloon is in an inflated condition to the preselected volume with the lighter-than-air gas to the preselected buoyancy, and the package having artwork indicative of the artwork on the surface of the balloon to illustrate the balloon in an inflated condition.

2. The marketing display kit as recited in claim 1 wherein said restraint line is double-ended and at least one of said ends includes an adhesive coating for adhesive attachment.

3. The marketing display kit as recited in claim 1 wherein the restraint line is double ended and both ends of the line include an adhesive coating for adhesive attachment to the balloon and the package.

4. The marketing display kit as recited in claim 1 wherein the kit further includes an overwrap enclosing the package and the balloon.

5. The marketing display kit of claim 1 wherein the kit further includes a weight for attachment to the restraint line.

6. A marketing display kit as recited in claim 1 wherein the artwork includes at least one word associated with an event.

7. A marketing display kit for a toy balloon, the kit comprising:

a package comprising a pocket;

a noninflated metallized balloon in the pocket;

the noninflated metallized balloon with a preselected volume to be inflated with a lighter-than-air gas upon removal from the package so as to assume a preselected buoyancy, the balloon having a surface with artwork which is displayed when the balloon is inflated; and the package including at least one slit aperture adapted to secure a neck of an inflated balloon to the package, the package having sufficient weight to balance the buoyancy of the balloon when the balloon is in an inflated condition to the preselected volume with the lighter-than-air gas to the preselected buoyancy, and the package having artwork indicative of the artwork on the surface of the balloon to illustrate the balloon in an inflated condition.

8. A marketing display kit as recited in claim 7 wherein the kit further includes an overwrap enclosing the package and the pocket.

9. A marketing display kit as recited in claim 8 wherein the package includes a second aperture and the overwrap includes an overwrap aperture, wherein the overwrap aperture and the second aperture in the package are aligned and form an aperture in the kit for hanging the kit and display thereof.

10. A marketing display kit as recited in claim 9 wherein the artwork includes at least one word associated with an event.

11. A marketing display kit as recited in claim 8 wherein the artwork includes at least one word associated with an event.

12. A marketing display kit as recited in claim 7 wherein the artwork includes at least one word associated with an event.

13. A method for providing a counterweight for a metallized balloon, the method comprising:

providing a noninflated metallized balloon;

packaging the noninflated metallized balloon with a balloon package which includes a pocket, the noninflated balloon adapted to be inflated with a lighter-than-air gas to a preselected buoyancy upon removal of the balloon from the balloon package;

inflating the balloon with a lighter-than-air gas to a preselected buoyancy to provide an inflated balloon;

providing a double ended restraint line, with one end attached to the balloon package and the other end attached to the inflated balloon, with the balloon package attached to the balloon having a predetermined weight sufficient to counterweight the metallized balloon when the balloon is inflated with a lighter-than-air gas; and providing artwork on at least one surface of the metallized balloon so as to be displayed when the balloon is inflated; and the balloon package is provided with artwork indicative of the artwork on at least one surface of the metallized balloon.

* * * * *